United States Patent [19]

Reed et al.

[11] 4,392,585

[45] Jul. 12, 1983

[54] STAR TRIP LABEL STRIPPER

[75] Inventors: Charles F. Reed, Madison; Charles M. Morrow, Painesville, both of Ohio

[73] Assignee: Avery International Corporation, Pasadena, Calif.

[21] Appl. No.: 287,111

[22] Filed: Jul. 27, 1981

[51] Int. Cl.[3] ..... B65H 5/28

[52] U.S. Cl. ..... 221/1; 221/71

[58] Field of Search ..... 156/DIG. 28, DIG. 33, 156/DIG. 48, 541, 542, 584; 221/71, 73, 74, 1

[56] References Cited

U.S. PATENT DOCUMENTS 2,987,591 6/1961 Ortenblad ..... 200/61.41

*Primary Examiner*—Stanley H. Tollberg

*Attorney, Agent, or Firm*—Pearne, Gordon, Sessions, McCoy, Granger & Tilberry

[57] ABSTRACT

Peel-back separation of labels from a supporting liner is enhanced by delivering a sharp blow in the vicinity of the leading edge of each successive label. In a preferred form of the invention, the sharp blow is delivered by means of a star wheel head.

10 Claims, 10 Drawing Figures

STAR TRIP LABEL STRIPPER

It has long been a practice in the label industry to provide rolls of pressure-sensitive adhesive labels in the form of a web of liner material and a succession of labels temporariliy adhered thereto on a face thereof, such construction being wound on itself to provide a roll of labels which may be conveniently dispensed.

When such liner-supported labels are dispensed, the liner material with the label on it is fed along a feed direction to a peel-back edge at the dispensing station, and the liner is drawn under tension around the peel-back edge and then in an outfeed direction which is divergent to the infeed direction. This peel-back drawing action imposes on the labels a tendency to continue to move in the original feed direction past the peel-back edge and to thus separate from the liner and thereby accomplish peel-back separation and dispensing of labels. The dispensing action may be continuous or intermittent, depending on whether the liner is continuously or intermittently drawn over the peel-back edge.

When the action is intermittent, the peel-back operation may be interrupted just short of completion of the separation of each successive label to thereby deploy the label with almost the entire area of its pressure-sensitive adhesive face exposed for pick-off by a passing workpiece which is to be labeled, or for pick-off by an operator where the labeling is not fully automatic but where deployment is accomplished automatically. Such interruption may be controlled by means for sensing the arrival of the leading edge of a succeeding label at a point which is a fixed distance from the peel-back edge. Since the labels are uniformly arranged along the liner, such succeeding label will be in register with the label being dispensed, so that accurate control is achieved. One means for sensing which has been employed is a star wheel feeler of the type shown in U.S. Pat. No. 2,987,591 to Ortenblad which is engaged by the leading edges of passing labels and is designed to be elevated by such engagement to a considerably greater height than the thickness of the labels, thereby giving a more reliable sensing and control action than feelers which are elevated only to the height of passing labels. Modifications and refinements of the Ortenblad star wheel feeler have long been used in the art for such sensing and control purposes.

Proper peel-back separation at a label dispensing station is dependent on a number of determining factors, including the flexibility of the label material and the strength of the adhesive bond between the labels and the liner to which the labels are intended to be only temporarily adhered. Even though the peel-back drawing action at the dispensing station tends to separate the labels from the liner, proper separation will not occur if the values of one or more of the determining factors depart too much from applicable norms. Such departures may in fact occur in actual manufacture due to changes or non-uniformity in materials or manufacturing conditions. When label rolls are manufactured which will not separate properly, they must be rejected, which is economically wasteful. Improper separation may not be detected by the label manufactuer, but only by the label user, necessitating costly replacement programs and costly delays in the label user's own production.

More generally, there have long been limitations on automatic deploying and/or dispensing of lighter gage and more flexible label materials. These limitations have prevented use of such materials in applications in which their use would otherwise be advantageous because of their lower cost and their better conformability and drape. A sufficient degree of "boardiness" of the label stock has been required to accomplish automatic deployment and/or dispensing, and "broady" stocks cannot be used on tight diameter workpieces, and require "quick wet-out" or quick-stick capability of the adhesive when used on curved surfaces. In particular, desirable label stock films, such as polyesters and vinyls, which are difficult to dispense in lighter gages, say ½ to 1½ mils, are expensive in gages compatible with satisfactory dispensing, say 4 mils.

In view of the foregoing considerations, there has long existed a need to enhance the peak-back separation of pressure-sensitive adhesive labels so as to allow wider tolerances in the values of such determining factors as boardiness, flexibility of label material, and quick wet-out capability, and so as to allow use of thinner gage materials, and use of label rolls which otherwise must be rejected. The present invention accomplishes these objects, and does so in a very simple and economical way.

We have discovered that if a blow is delivered against the non-adhesive face of each successive pressure-sensitive adhesive label in the vicinity of its leading edge, and if such blow is sufficiently sharp, labels which would otherwise fail to do so will successfully separate at the peel-back edge. Separation is enhanced even though the impact of the blow is in such a direction as to apply pressure to the pressure-sensitive adhesive, i.e., is in such a direction as to press the adhesive label against the liner, so that adhesion in the vicinity of the leading edge of the label could be expected to be increased rather than decreased. It can be conjectured that the sharp blow has a rheological effect on the pressure-sensitive adhesive at the leading edge such as to actually decrease adhesion, despite the direction of the blow, but the theory of how this may happen is not clear. Whatever the explanation, a valuable improvement is achieved which overcomes the limitations discussed above.

We have further discovered that the separation enhancing action referred to can be accomplished with star wheel feelers which are similar to those of the prior art, except that spring tension or "stiffness" is increased to give the required sharp blow as the wheel passes by dead center and tension is relieved.

The invention is illustrated in the accompanying drawings, in which.

Figure 8:
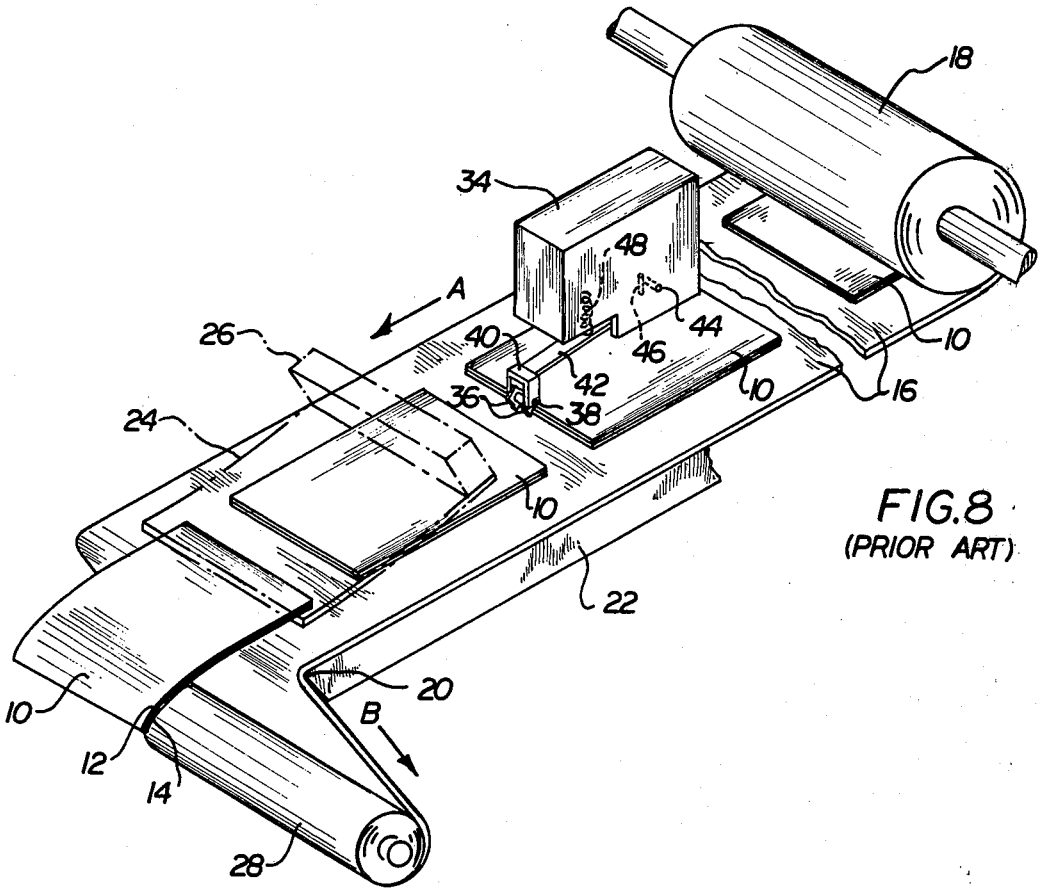
FIG.8 (PRIOR ART)
FIG. 8 is a schematic sketch similar to FIGS. 1 and 2, and illustrating a type of prior art label dispensing arrangement.

In the prior art system seen in FIG. 8, a liner web 16 carries a succession of equally spaced labels 10. For clarity, the illustration exaggerates the spacing of the labels from each other and the width of the liner compared to the labels. The labels each comprise a label body 12 and a pressure-sensitive adhesive 14 permanently associated with the label body 12 and intended to be temporarily adhered to the liner 16.

The labels 10 are fed along the liner infeed path A which leads to a peel-back edge 20 formed on a peel plate 22. The labels and liner may be held down against the peel plate 22 in the vicinity of the peel-back edge 20 by a resilient hold-down member 24 supported by a mounting bar 26, the latter two elements being illustrated in phantom in FIG. 8. The liner 16 is drawn from the peel-back edge 20 along a liner outfeed path B which is divergent from the infeed path A. The liner 16 is wound on a take-up roll 28 which also provides the driving power to draw the liner 16 from the label roll 18, along the path A, around the peel-back edge 20 and along the path B.

The labels 10 are spaced at regular intervals on the liner 16. In order to stop each successive label 10 at the properly deployed position at the outer end of the peel plate 22, a star wheel feeler 34 is provided. This feeler is of the general type shown in Ortenblad U.S. Pat. No. 2,987,591, and operates on the same principle. A typical modern star wheel arrangement comprises a pair of individual four-pointed star wheels 36 fixed at opposite ends of a sleeve which is mounted for rotation on an axle 38 carried on a yoke 40, which is in turn carried on an arm 42 pivotally mounted on the body of the feeler 34 at a pivot pin 44. A microswitch (not shown) mounted in the body of the feeler 34 has a downwardly facing feeler or actuator 46 which is engaged by the arm 42. The arm is urged downwardly by a light spring 48.

As the leading end of each label is engaged, the star wheel feeler elevates the arm 42 by a considerably greater distance than the thickness of the label, thereby giving more reliable actuation of the control microswitch than is achieved with a feeler which is elevated only to the height of the label.

Figure 9A:
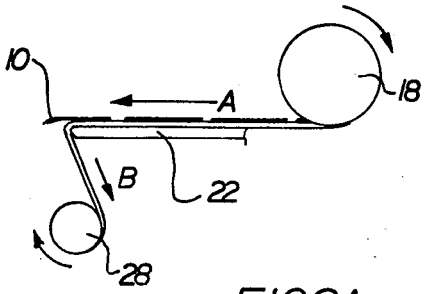
FIG.9A (PRIOR ART)
FIG. 9A is a diagrammatic sketch corresponding to FIG. 8.
Figure 9B:
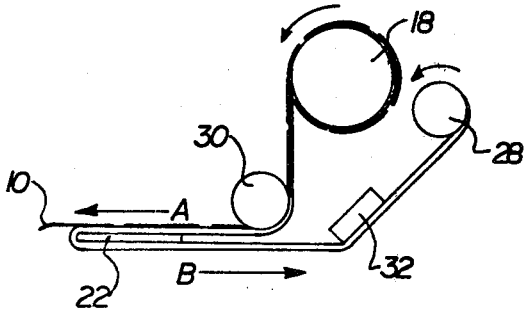
FIG.9B (PRIOR ART)
FIG. 9B is another similar diagrammatic sketch illustrating a similar configuration of parts which is more complicated but also more typical of actual practice.

The configuration of parts seen in FIG. 8 has been simplified for ease of illustration. This simplified configuration is also seen in FIG. 9A. A configuration more typical of actual practice is seen in FIG. 9B. Here, the rolls 18 and 28 are located well above the level of the peel plate 22, and guide members, such as the guide roll 30 and guide bar 32, are provided to guide the liner 16 from and to these elevated rolls. In FIG. 9B, the infeed and outfeed paths A and B are even more sharply divergent than in FIG. 9A, and in fact approach maximum divergence of 180 degrees. Also, the label roll 18 is provided with the labels wound on the outer side, rather than on the inner side as seen in FIG. 9A.

The arrangement illustrated in FIG. 9B allows workpieces being labeled (not shown) to be carried by conveyor means (not shown) horizontally under the apparatus so as to contact the undersides of the successively deployed labels to thereby automatically pick the labels off.

The prior art described above does not enhance label separation, and does nothing to overcome the limitations discussed earlier in respect of ease of dispensing.

Figure 1:
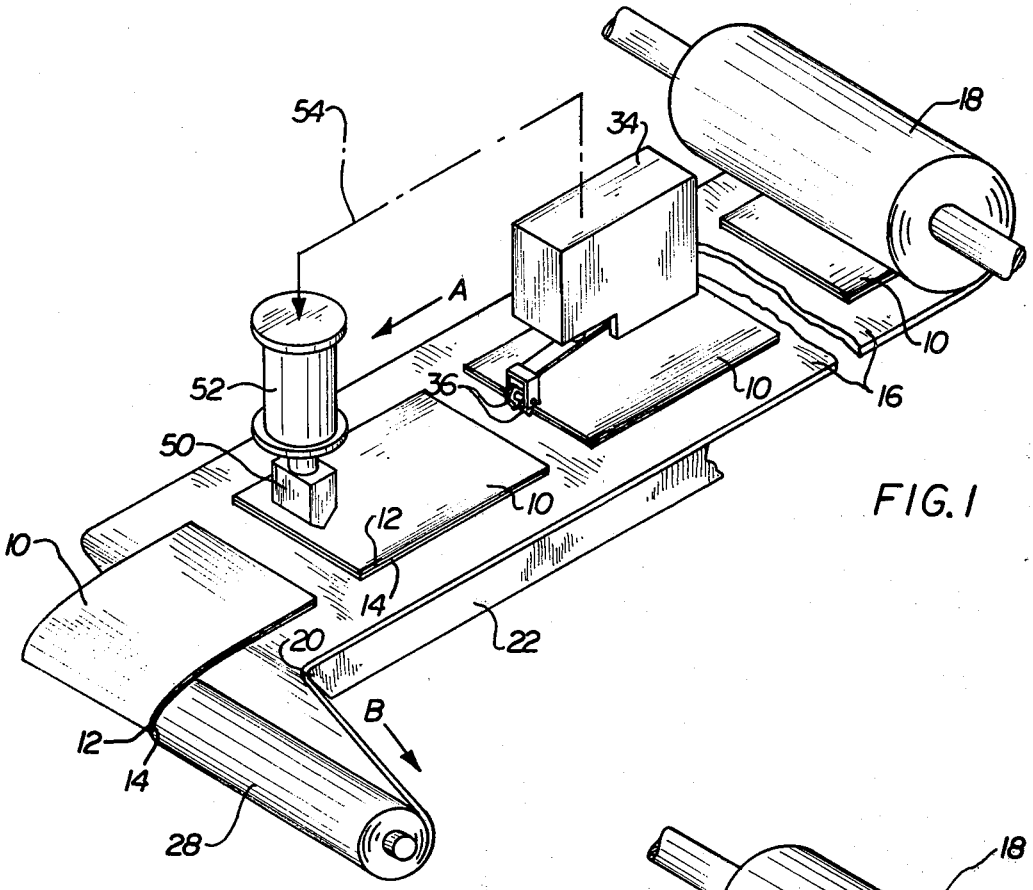
FIG. 1 is a schematic sketch illustrating one form of the invention.

The present invention is illustrated schematically in FIG. 1. It will be understood that the configuration of elements in FIG. 1 is simplified for ease of illustration, and that an actual installation would vary from FIG. 1 similarly to the variance of FIG. 9B from FIG. 9A. Many of the elements shown in FIG. 1 are the same as those described in FIG. 8, and are given the same reference numerals.

However, the star wheel feeler 34 of FIG. 1, besides controlling the deploying of successive labels 16, also controls separation enhancing means, now to be described. An impact member 50 is positioned above the infeed path of the labels in such a position that when the labels are in indexed position, with the endmost label properly deployed, the member 50 is above a point in the vicinity of the leading edge of a label behind the deployed label, preferably the label that is immediately behind the deployed label, as shown in FIG. 1, although the impact member may instead be placed above a label position which is displaced further from the deployment position, so as, for example, to provide clearance for a hold-down member (not shown) similar to the hold-down member 24 of FIG. 8.

The impact member 50 is powered by a solenoid 52 controlled directly (or indirectly via relays or semiconductor switches or the like) by the microswitch (not shown) associated with the star wheel feeler 34, as symbolized by the dashed flow line 54. The microswitch of the star wheel feeler 34 may also continue to control the deployment of the endmost label 10, as in the prior art. As the liner 16 stops its advance due to actuation of the star wheel feeler, the solenoid 52 is energized to cause the impact member 50 to strike a sharp blow against the top face of the label below it. The blow is delivered near the leading edge of the label, and the impact member 50 is then returned to its raised position by suitable means such as a return spring (not shown).

Such sharp blow enhances the tendency of the labels 10 to continue to move along the direction of the infeed path A past the peel-back edge 20. Such tendency is enhanced to the point where there is accomplished the separation of labels which would otherwise resist such tendency and fail to separate.

Figure 2:
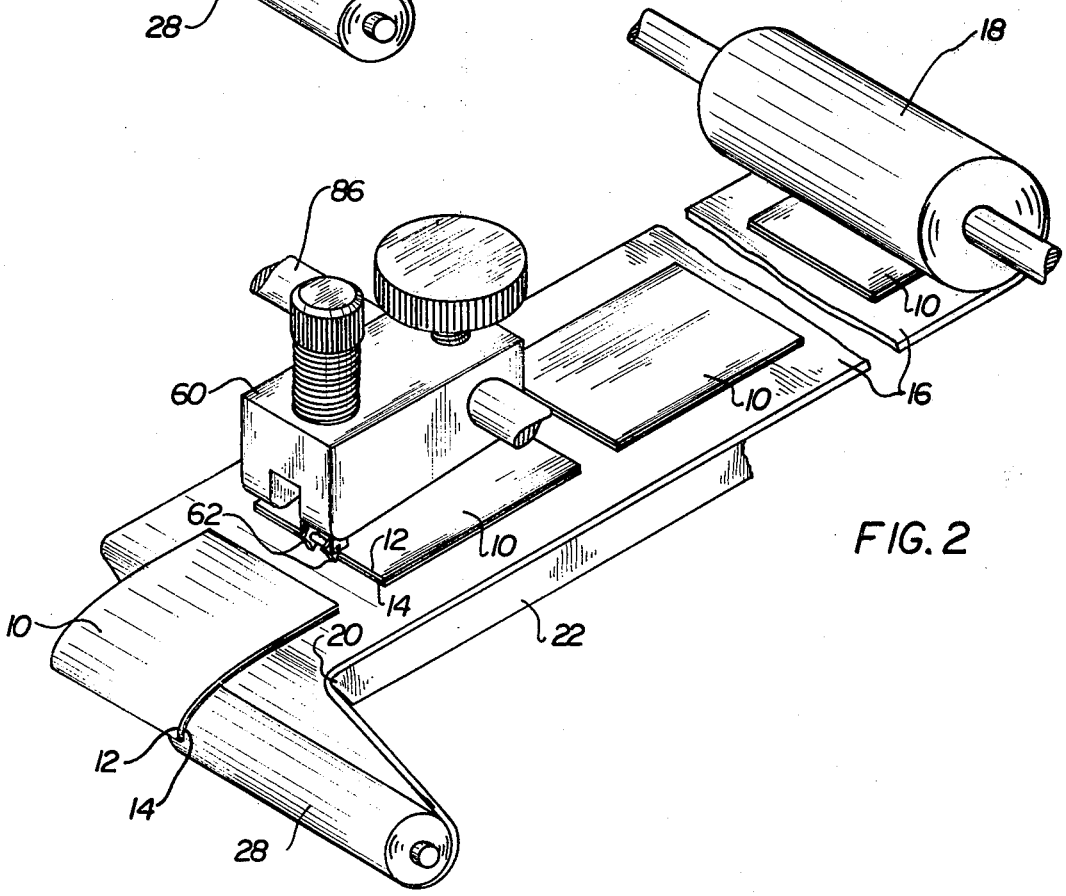
FIG. 2 is a similar sketch illustrating a presently preferred form of the invention.

A presently preferred form of the invention is illustrated in FIGS. 2–7. Here again, it will be understood that the configuration of elements illustrated schematically in FIG. 2 is simplified for ease of illustration, and that an actual installation would vary from FIG. 2 similarly to the variance of FIG. 9B from FIG. 9A. Again, many of the elements shown in FIG. 2 are the same as those described in FIG. 8, and are given the same reference numerals.

The apparatus of FIG. 2 may be provided with a conventional star wheel feeler (not shown) similar to the feeler 34 shown in FIGS. 8 and 1 for controlling indexing of the liner for proper deployment of the endmost label, or this may be accomplished by any other suitable means. In some applications, continuous rather than intermittent feed of labels past the peel-back edge 20 may be desired, in which case no indexing means may be required.

Figure 3:
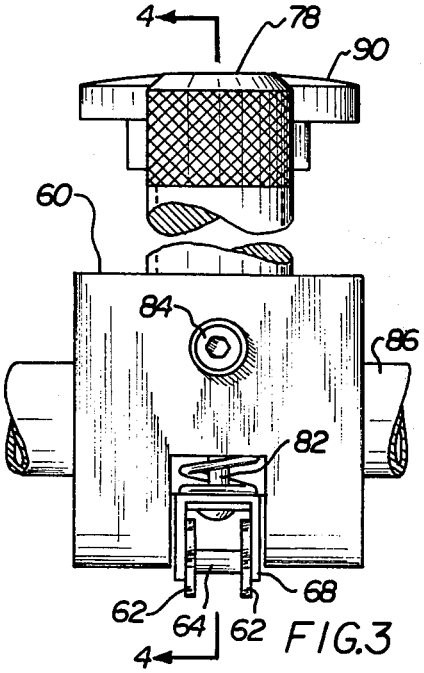
FIG. 3 is a fragmentary detail view of part of the apparatus seen in FIG. 2.
Figure 4:
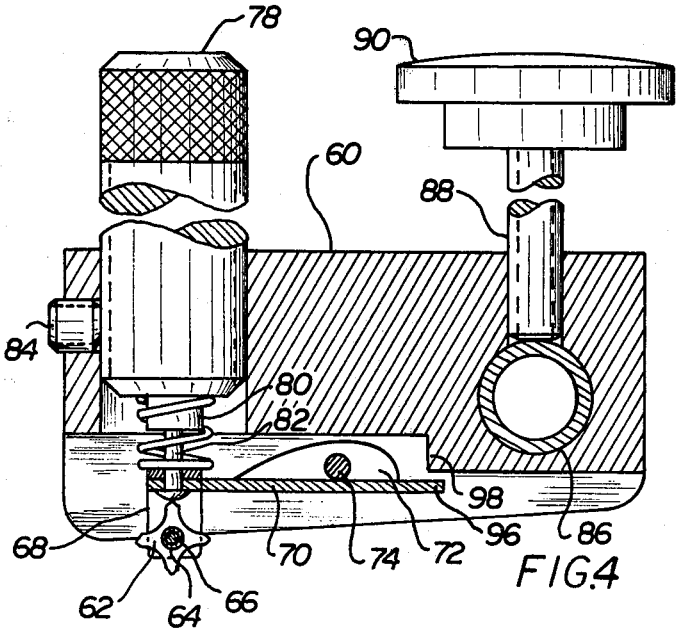
FIG. 4 is a cross section taken on the plane of line 4—4 of FIG. 3.

The impact means in FIG. 2 is in the form of a modified star wheel device which no longer acts merely as a star wheel feeler, but which constitutes a star trip impactor 60 (FIGS. 2–4). This device includes a pair of individual star wheels 62 fixed at opposite ends of a sleeve 64. The sleeve is rotatably mounted on an axle 66 (FIG. 4) which is fixed to a yoke 68 carried on the end of an arm 70. The sides of the arm 70 are provided with a pair of upstanding flanges 72, only one of which is seen in FIG. 4. These are pivotally mounted on an axle 74.

A stiff spring 76 is positioned directly over the yoke 68 and star wheels 72, and is retained by a threaded adjusting plug 78 which may have a boss 80 (FIG. 4). A rivet or screw 82 may be provided fixed to the yoke 68 and adapted to engage the lower end of the boss 80 to limit upward movement of the star wheels 62. The spring 76 may be centered by the boss 80, as shown. The adjusted position of the adjusting plug 78 is maintained by a setscrew 84.

The star trip impactor may be supported on a fixed mounting rod 86 and held in adjusted position by means of a setscrew 88, which may be manually loosened and tightened by means of a knob 90.

Figure 5:
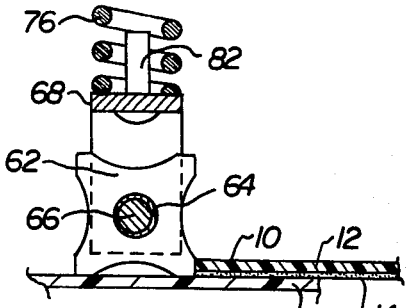
FIGS. 5–7 are views illustrating various operating positions of certain parts.
Figure 6:
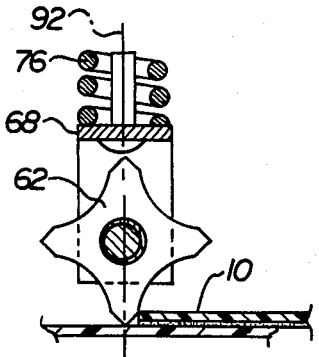
Figure 7:
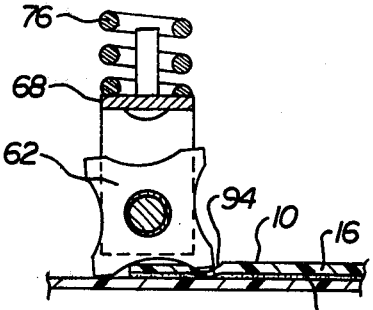

The tripping action of the star trip impactor is illustrated in FIGS. 5–7. As a label approaches the star wheels 62 from the right, the leading end of the label engages the star wheels as seen in FIG. 5. As the label subsequently advances, the star head (the star wheels 62 and associated parts) rises upwardly to compress the stiff spring 76. The point of maximum compression is seen in FIG. 6, and is the point where the large diameters of the star wheels pass through the imaginary vertical centerline 92. As this point is passed, the star head trips downwardly under the force of the loaded spring, causing the rearwardly oriented points of the star wheels to snap downwardly and strike a sharp blow against the top face of the label 10 at location 94 in the vicinity of the leading edge of the label. Even though this sharp blow is downward, and thus applies pressure to the pressure-sensitive adhesive 14, so that adhesion to the liner 16 could be expected to be increased rather than decreased, the result of the impact is such as to enhance the tendency of the label 10 to continue in the same direction past the peel-back edge.

The height of the star wheel centers above the peel plate 22 (FIG. 2) may be adjusted by means of adjustment of the setscrew 88 to bodily pivot the body of the star trip impact 60 around the fixed mounting rod 86 as desired. Downward movement of the head may be limited by the engagement of the arm end 96 with the shoulder 98. Upward movement of the head may be limited by adjustment of the adjusting plug 78. These various adjustments allow for adjustment for the most effective separation enhancing action in any given application.

Hold-down means (not shown) may be provided for the version of the invention shown in FIG. 2. Such hold-down means may comprise a hold-down member similar to member 24 of FIG. 2, but passing under the star trip impactor with a suitable notch at its free end to allow the star wheels 62 to project through.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. In a method of dispensing a succession of adhesive labels from a web of liner material to which the labels are temporarily adhered by feeding the liner with the labels thereon along a liner infeed path which leads along a first direction to a peel-back edge at a dispensing station, with the liner contacting the peel-back edge and the succession of labels each spaced from the peel-back edge by the thickness of the liner, and drawing the liner under tension over the peel-back edge and away therefrom along a liner outfeed path which leads from said peel-back edge in a second direction that is divergent from said first direction to thereby impose on the labels a tendency to continue to move in said first direction beyond said peel-back edge and thus to separate from said liner, the improvement which comprises striking a blow against the non-adhesive face of each successive label in the vicinity of the leading edge thereof, such blow being sufficiently sharp to enhance such tendency to the point where there is accomplished the separation of labels which would otherwise resist such tendency and fail to separate.

2. A method as set forth in claim 1, in which said sharp blow is struck against each successive label prior to the arrival of the struck portion of the label at the peel-back edge.

3. A method as set forth in claim 1, including sensing when each successive label reaches a given point of feed, and striking such sharp blow at such time.

4. A method as set forth in claim 1, including mechanically engaging the leading edge of each label as it reaches and passes a given point of feed, and using such engagement to mechanically control the striking of such sharp blow.

5. A method as set forth in claim 4, including using the initial parts of such engagement to load a spring-loaded impact head located in the vicinity of said given point of feed, and using a subsequent part of such engagement to trigger said impact head and release said loaded spring.

6. In apparatus for dispensing a succession of adhesive labels from a web of liner material to which the labels are temporarily adhered, such apparatus having a peel-back edge and having means for feeding the liner with the labels thereon along a liner infeed path which leads along a first direction to the peel-back edge and for drawing the liner under tension over the peel-back edge and away therefrom along a liner outfeed path which leads from said peel-back edge in a second direction that is divergent from said first direction to thereby impose on the labels a tendency to continue to move in said first direction beyond said peel-back edge and thus to separate from said liner, the improvement which comprises impact means for striking a blow against the non-adhesive face of each successive label in the vicinity of the leading edge thereof, such blow being sufficiently sharp to enhance such tendency to the point where there is accomplished the separation of labels which would otherwise resist such tendency and fail to separate.

7. Apparatus as set forth in claim 6, in which said impact means strikes said sharp blow against each successive label prior to the arrival of the struck portion of the label at the peel-back edge.

8. Apparatus as set forth in claim 6, including means for sensing when each successive label reaches a given point of feed, and actuating such impact means at such time.

9. Apparatus as set forth in claim 6, including means for mechanically engaging the leading edge of each label as it reaches and passes a given point of feed, such impact means being mechanically driven and actuated by said engagement.

10. Apparatus as set forth in claim 9, such impact means including an impact head and a spring adapted to spring-load such impact head, said head being spring-loaded by the initial parts of said engagement, said head being triggered by a subsequent part of said engagement to release said spring loading.

* * * * *